US005301489A

United States Patent [19]

Benedetti

[11] Patent Number: 5,301,489

[45] Date of Patent: Apr. 12, 1994

[54] CONVEYING DEVICE WITH LEVERS FOR WRAPPING MACHINES DESIGNED FOR DELICATE PRODUCTS, EQUIPPED WITH A GRIPPING DEVICE FOR STRIPS OF MATERIAL FOR WRAPPING PRODUCTS, AND MACHINE WITH SAID CONVEYING DEVICE

[75] Inventor: Gino Benedetti, Funo di Argelato, Italy

[73] Assignee: B.F.B. S.p.A., Italy

[21] Appl. No.: 924,900

[22] Filed: Aug. 4, 1992

[51] Int. Cl.[5] ..... B65B 11/28; B65B 49/00

[52] U.S. Cl. ..... 53/234; 53/232; 156/443

[58] Field of Search ..... 53/234, 233, 232, 225, 53/389.1, 590, 586, 375.9; 156/566, 443, 576, 481, 489, DIG. 40

[56] References Cited

U.S. PATENT DOCUMENTS

| | | | |
|---|---|---|---|
| 2,603,925 | 7/1952 | Moore . | |
| 2,723,516 | 11/1955 | Malhiot | 53/234 X |
| 2,933,871 | 4/1960 | Brook | 53/234 |
| 3,733,774 | 5/1973 | Duchinsky et al. | 53/232 |
| 3,987,605 | 10/1976 | Johnson | 53/234 |
| 4,361,454 | 11/1982 | Nakahama et al. | 156/576 X |
| 4,490,198 | 12/1984 | Mitchell | 156/576 X |
| 4,539,791 | 9/1985 | Zamboni | 53/234 |
| 4,605,459 | 8/1986 | Voltmer et al. | 156/566 X |

FOREIGN PATENT DOCUMENTS

| | | |
|---|---|---|
| 2068883 | 8/1981 | United Kingdom . |
| 2220187 | 1/1990 | United Kingdom . |

*Primary Examiner*—John Sipos
*Assistant Examiner*—Linda B. Johnson
*Attorney, Agent, or Firm*—Stevens, Davis, Miller & Mosher

[57] ABSTRACT

A conveying device with levers for wrapping machines for delicate products equipped with a gripping device for strips of material for wrapping products. The device has a supporting structure sliding on a radial guide which forms part of a carrousel conveyor revolving around a support placed on a supporting plate; a first operating lever for conveying the products, rotates around a first pivot supported by the supporting structure; a second operating lever for conveying the products rotates around a second pivot supported by the supporting structure; a limit stop for the movements of one of the levers is integral with the supporting structure, the purpose of which is to cooperate with one of the said operating levers, constitute a gripping device for the strips.

10 Claims, 5 Drawing Sheets

CONVEYING DEVICE WITH LEVERS FOR WRAPPING MACHINES DESIGNED FOR DELICATE PRODUCTS, EQUIPPED WITH A GRIPPING DEVICE FOR STRIPS OF MATERIAL FOR WRAPPING PRODUCTS, AND MACHINE WITH SAID CONVEYING DEVICE

BACKGROUND OF THE INVENTION

The present invention consists of a conveying device with levers used in wrapping machines for delicate products like bars of soap which have just come out of a stamper. It has a device for gripping individual strips of material to wrap products. This invention is also of the type of wrapping machine provided with a conveying device.

Wrapping machines for delicate products have a large number of conveying devices. These consist essentially of many components whose function is to wrap the objects produced by the machine in suitable wrapping material.

Essentially, one of these components has a flat surface which accommodates a strip of wrapping paper, against which one side of the bar of soap is in contact, the wrapping material being fed in single strips by a feeding device. It has two levers to keep the side of the soap in contact with the wrapping material on the flat surface, while the machine moves the conveying device continuously or intermittently from a loading station to an unloading station. There are kinematic devices to maintain the correct movement of the device and its components from said stations.

In addition, there are devices for gripping the wrapping material, between which the products are wrapped to form the final product ready for sale.

The gripping devices work together with the feeding device which is housed in a first structure of the machine, and are assembled on the conveying device or arranged in a second fixed component of the machine.

U.S. Pat. No. 2,723,516 to Malhiot shows a wrapping machine equipped with a device for feeding strips of wrapping material integral with a fixed structure of the machine, and designed to place a strip of wrapping material on a conveying device prior to a bar of soap being deposited on it. A similar device transfers the strips on a conveying device only if the machine is working slowly; in fact, the transferral of the strips from the feeding device to the flat supporting surface of the conveying device can only take place in the correct fashion if the conveying device comes into contact with the feeding device for a sufficient length of time to allow the strip to be transferred from the feeding device to the conveying device, the bar of soap being placed in contact with the strip.

European Patent Application number 90103891.9 filed by the applicant is for a high-speed wrapping machine equipped with a large number of devices for conveying soap, having pincers for gripping the wrapping material coming out individually from a feeding device similar to that described for U.S. Pat. No. 2,723,516. Every conveying device of the European patent is equipped with a gripping pincer which is connected to kinematic devices which control it during the various phases of the machine's operation.

In the cases under consideration the gripping devices for wrapping material have the following disadvantages:

they are connected to kinematic devices which have only a single purpose;

they have an inertial mass which requires an increase in energy to make them work;

the kinematic devices to which they are attached must be perfectly in phase with the continuous or intermittent movements of the machine so as to permit the wrapping paper to be transferred in synchrony with the movement of the conveying device in the proximity of the feeding device.

SUMMARY OF THE INVENTION

The purpose of the present invention is to remove these disadvantages. The invention as claimed is intended to solve the problem of producing a conveying device with levers for a wrapping machine for delicate products and provided with a gripping device strips of wrapping material to wrap products; this invention also relates to a machine with said conveying device. The invention is capable of transferring the wrapping material from the feeding device to the conveying device when the latter engages with the feeding device, using a gripping device formed by one of the two levers and by a limit stop of the same lever. The limit stop is integral with the conveying device.

The advantages obtained by the invention are above all the elimination of the kinematic devices and, due to reduction of the inertial mass and the energy consumption required to move the inertial mass, an increase in the wrapping speed and greater simplicity regarding design, construction and assembly of the components which make up set in operation the conveying device.

In accordance with a preferred embodiment, the conveying device with levers for wrapping machines of delicate products consists of a supporting structure which moves slidably on a radial guide which forms part of a carrousel conveyor which revolves around a support placed on a supporting plate; a first and a second operating lever which rotate around a first and second pivot supported by the supporting structure, said levers supporting the product during the movement of the support structure from a first loading station of the products in the machine to a second unloading station of products from the machine; a limit stop for the angular movement of one of the first operating levers in the direction of the first towards the second lever; the limit stop being integral with the support structure and cooperating with the first operating lever to constitute the gripping device for the strips; means of controlling movements of the operating levers during rotation of the carrousel conveyor; the machine further comprises guiding devices for the ends of the strips, which emerge from a feeding device.

Preferably, the limit stop consists of a bracket which projects laterally from the support structure.

The bracket has the advantage of having a curvature which allows the furthest free part to be placed in a position giving access to the free end of the first operating lever.

In addition, the bracket is made of elastic material which bends owing to the action of the free end of the lever.

The bracket is situated in the front part of the supporting structure in the direction of rotation of the conveyor device.

In a successive embodiment of this invention, the movements of one of the operating levers are controlled by a command lever, which has a first end integral with the same lever and a second end which supports a bearing in a grooved section which develops in the supporting plate and is closed on itself; the movements of the other operating levers are controlled by a gear consisting of a first toothed wheel set at an angle to the operating lever and controlled by the command lever and by a second toothed wheel set at an angle to the other operating lever.

The guiding devices for the ends of the strips consist of an internal surface of a guiding component, the surface bringing the strip almost into contact with the flat supporting surface furnished by the conveying device. The guiding component extends from one position of the conveying device adjacent to the feeding device of the strips and another position where the strip is situated between the flat support surface and one side of the product.

BRIEF DESCRIPTION OF THE DRAWINGS

Other advantages, details and characteristics of the invention may be appreciated in the following description of a preferred construction of the conveying device and accompanying machine by referring to the illustrations, which demonstrate.

DETAILED DESCRIPTION OF THE INVENTION

Figure 1:
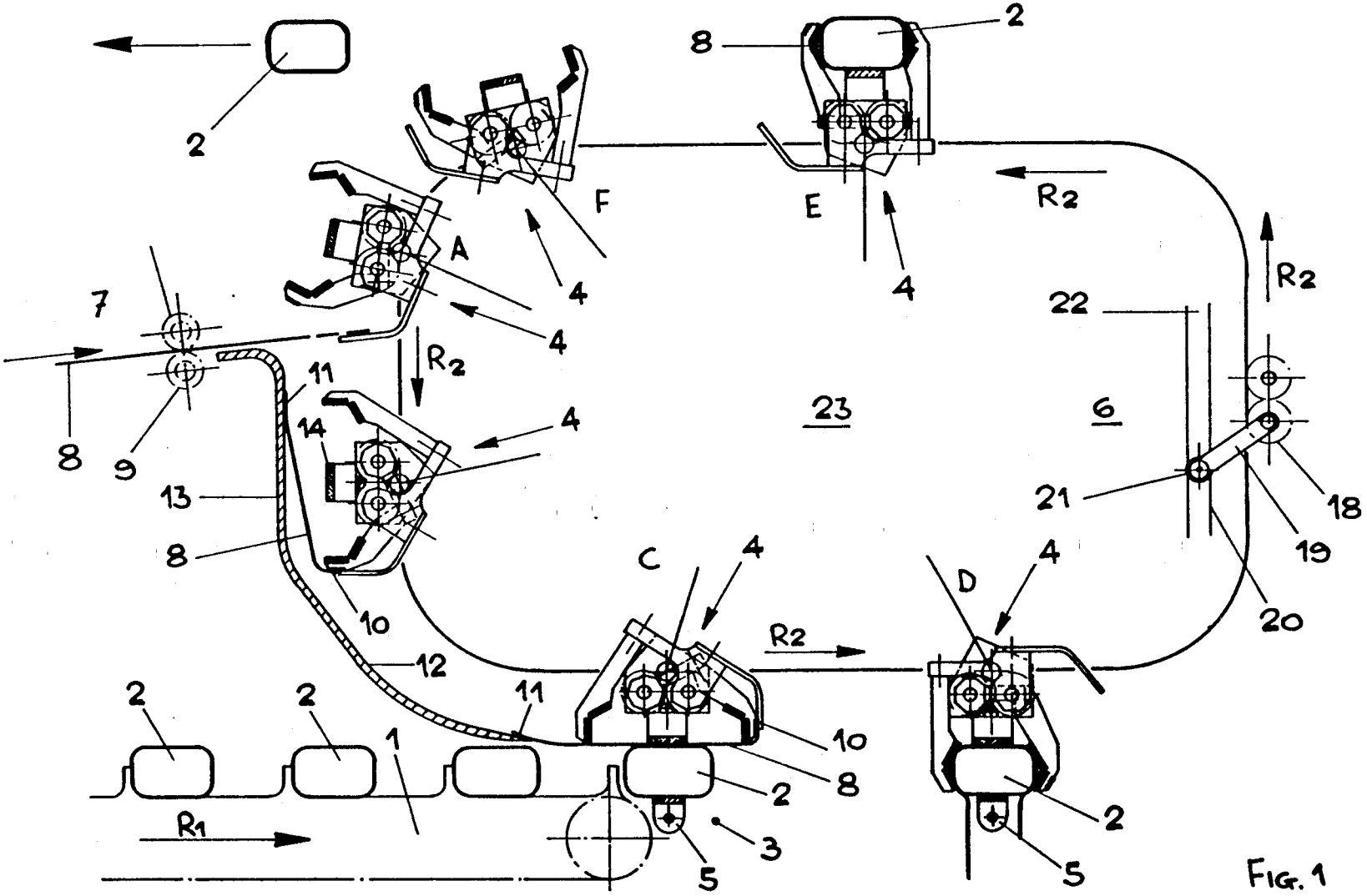
FIG. 1 is a schematic view of the wrapping machine including all the invention's conveying components, according to the invention.

FIG. 1 shows a wrapping machine with a conveyor belt 1 of the kind described above in connection with European Patent Application No. 90103891; the supporting part of conveyor belt 1 moves in the direction $R_1$ in order to convey the products 2 from a loading station (not shown) to a transfer station 3 of products 2 from the conveyor belt 1 to a conveyor device 4 with levers.

As described in the above mentioned European Patent Application, there is a supporting component 5 in the transfer station 3, the flat surface of the former supporting a product 2 before being finally grasped by the conveying device 4 with levers.

In order to show how the conveying devices 4 revolve with a carrousel conveyor 6 in the direction of rotation $R_2$, FIG. 1 shows six conveying devices 4 in six different positions on the carrousel conveyor 6 and with the operating levers in different working positions in relation to the products 2, as described in the above, European Patent Application.

In a first position A the conveying device 4 receives a strip 8 of wrapping material from a feeding device 7, the feeding device 7 being schematically illustrated by two idler wheels 9.

In a second position B the gripping device of the conveying device grips one end 11 of the strip 8, the other end of which, during the movement of the conveying device 4 from position B to a third position C, is kept in contact with an internal surface 12 of a guiding component 13 for the ends so as to nearly bring the strip 8 into contact with the flat supporting surface 14 of the conveying device 4, the other side of which is supported by the flat surface of product 2.

In a fourth position D the operating levers of the conveying device 4 together with the flat surface of device 5 support the product 2 in order to allow the mechanisms of said machine to wrap the product, a process which will have been completed when the conveying device reaches a fifth position E.

In a sixth position F, the conveying device 4 places the product 2 in an unloading conveyor belt (not shown); its gripping levers are therefore clear of the product 2.

Figure 2:
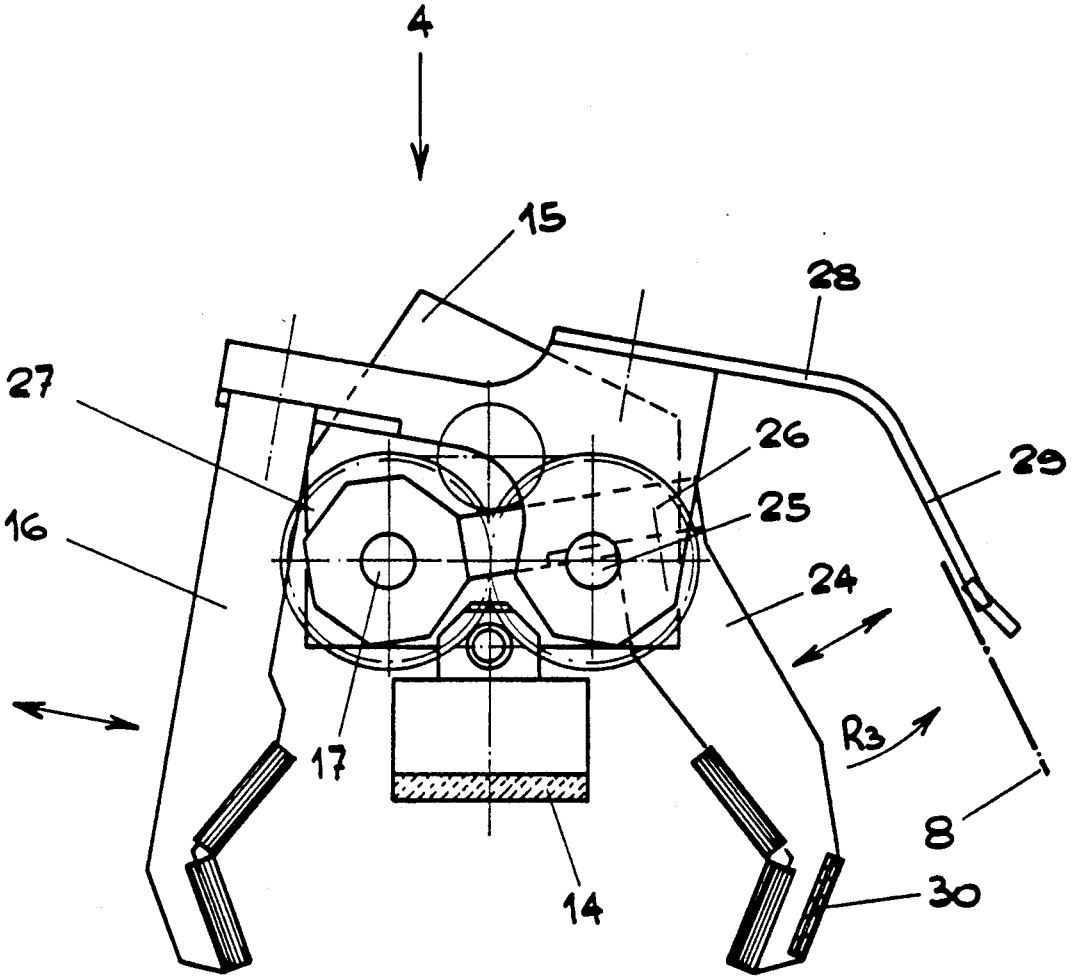
FIG. 2 is a view of the conveying device with levers place in a first position.

FIG. 2 shows the conveying device 4 (enlarged) in the first position A.

The flat supporting surface 14 is situated at the end of a supporting structure 15 of the carrousel conveyor 6 as specified in said European Patent Application. A first operating lever 16 for moving the products 2 revolves around a pivot 17 which is situated in the supporting structure 15, the rotation axis of which is perpendicular to the path of the movement of the conveying devices 4. The action of the lever 16 has been described fully in said Application; we repeat, however, that lever 16 is set at an angle to a first end 18 of a command lever 19 shown in FIG. 1, the other end of which 20 supports a bearing 21 in a grooved section 22 which is in a support plate 23 and is closed on itself; the plate 23 is provided with a support for the carrousel conveyor 6.

A second operating lever 24 for transferring the products 2 rotates around a pivot 25 which is situated in the supporting structure 15, the rotation axis of which is perpendicular to the path of the movement of the conveying device 4.

Lever 24 operates by means of a gear comprising a toothed wheel 26 which engages with toothed wheel 27; the toothed wheels 26 and 27 are integral with levers 24 and 16, respectively.

The supporting structure 15 supports a bracket, which is integral with it, and which projects laterally from structure 15. Bracket 28 has a curvature which facilitates the movement of its free end 29 to a position which can be reached by an adhesive element 30 which is supported by the free end of the operating lever 24. The end 29 constitutes the limit stop of the angular movement of lever 24 in direction R3 away from lever 16.

Preferably, bracket 28 consists of a bar of elastic material which bends owing to the action of lever 24.

Bracket 28 has the advantage of being situated in the front part of the support structure 15 in the direction of rotation $R_2$ of the conveying device 4; this location of bracket 28 in structure 25 permits a correct grip of strip 8 by the gripping device which is constituted by the free end 29 of bracket 28 and the end 36 of lever 16, which is equipped with an adhesive element 30.

Figure 3:
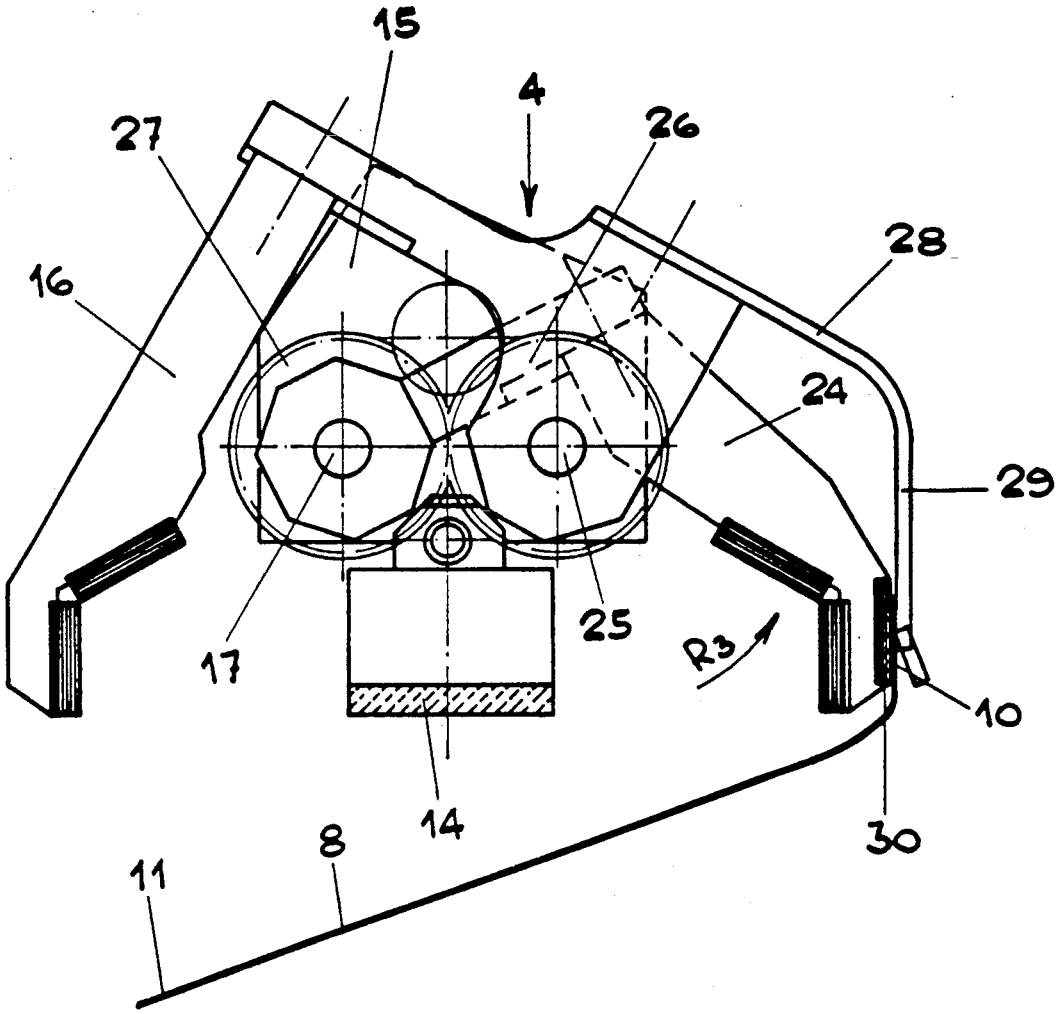
FIG. 3 is a view of the conveying device with levers in a second position.

FIG. 3 shows the conveying device 4 which is in position B in FIG. 1. In this position adhesive element 30 is placed in contact with free end 29 so that the end 10 of strip 8 is drawn by the gripping device. While element 4 moves towards position C, the surface 12 keeps the second end 11 extremely near the flat support surface 14, to make sure that contact takes place between a central part of strip 8 and the flat surface 14 when in position C.

The angular movement of lever 24 in the direction of rotation $R_3$ is obtained by the two toothed wheels 26 and 27 which transmit the rotational motion of lever 16 to lever 24. Lever 16 rotates as a result of the action of command lever 19, the end of which 20 must follow section 22, as described in said Application.

Figure 4:
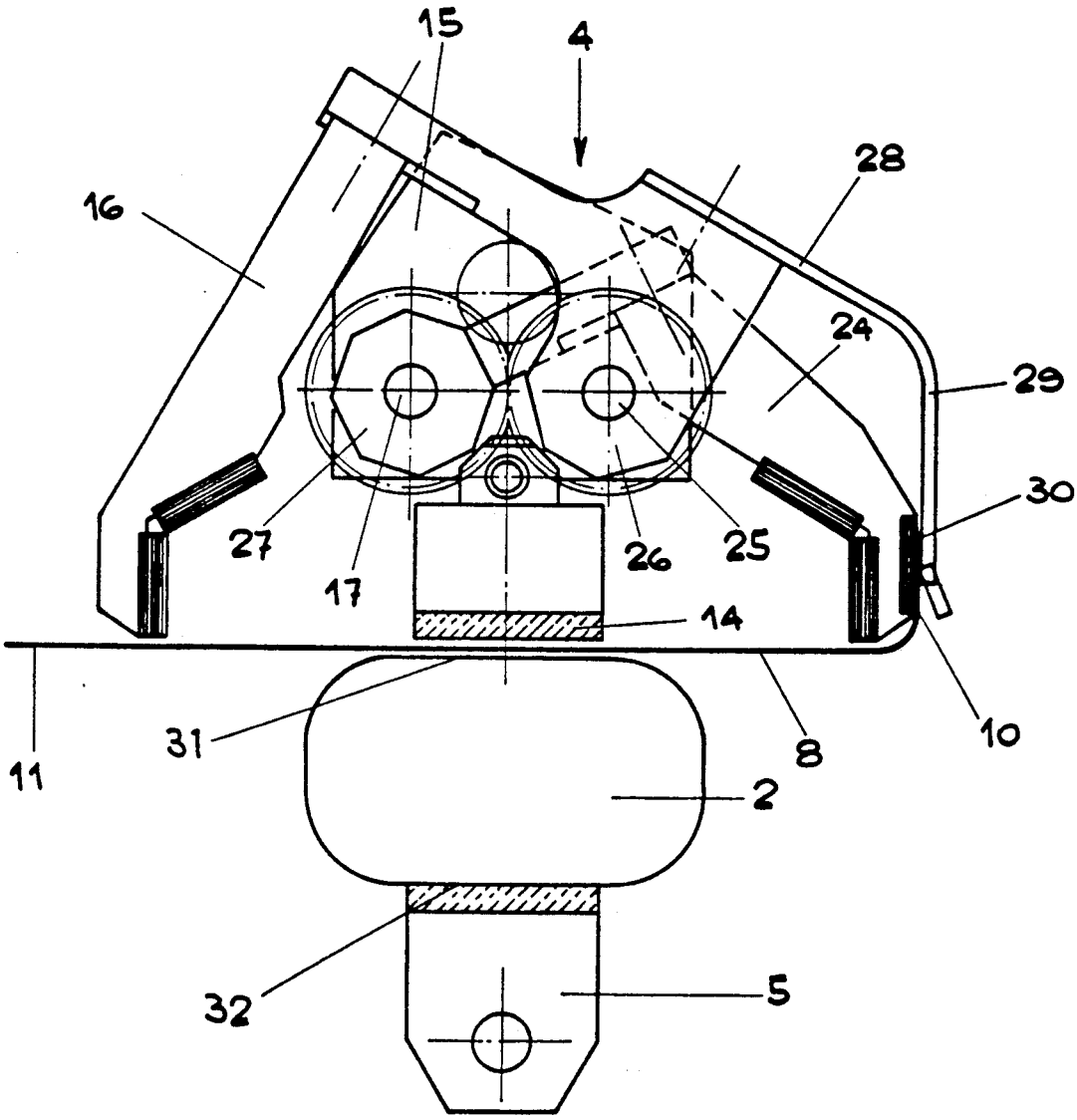
FIG. 4 is a view of the conveying device with levers in a third position.

FIG. 4 shows the conveying device 4 in position C as in FIG. 1. At this point, adhesive element 30 is kept in contact with free end 29 to permit strip 8 to be inserted between the flat surface 14 and one side of the product 2, the other side of which 32 is resting on the flat surface of supporting component 5. The angular positioning of levers 16 and 24 remains unaltered to allow the gripping device to keep the end 11 of the strip 8 taut.

Figure 5:
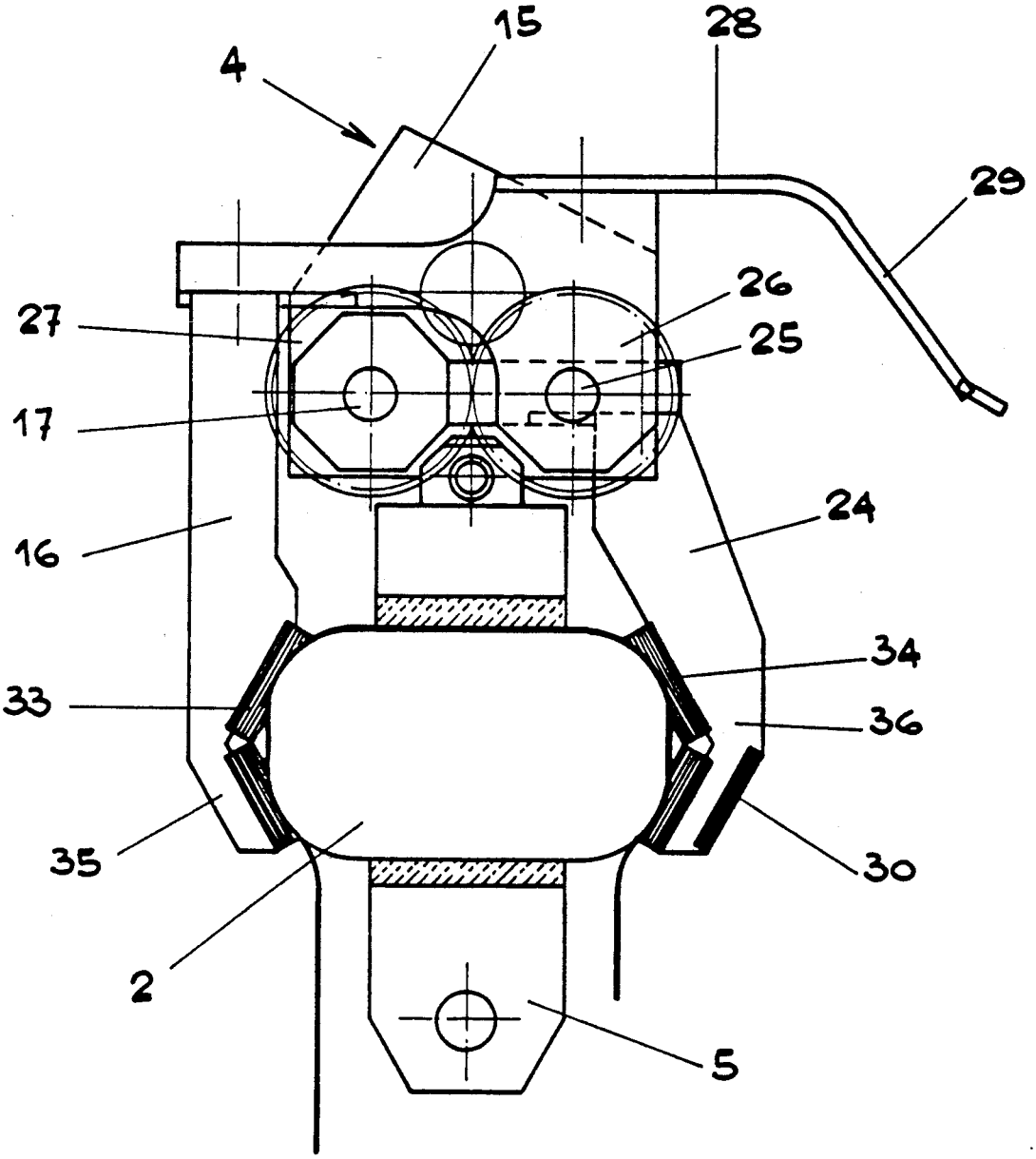
FIG. 5 is a view of the conveying device with levers in a fourth position.

FIG. 5 shows the conveying device 4 in position D as in FIG. 1. At this point, the end 35 of lever 16 is brought into contact with a side 33 of the product 2 owing to the action of command lever 19, and the end 36 of lever 24 is brought into contact with the other side 34 of product 2; the movement of lever 24 is achieved by the rotation of toothed wheel 27 which engages with toothed wheel 26.

In the next position E as in FIG. 1, the angular positions of levers 16 and 24 remain unaltered, although strip 8 has already been folded and heat sealed to achieve complete wrapping of the product 2.

In position F, the product wrapped in the strip is released from levers 16 and 24, which are now in the position shown in FIG. 2, to start another wrapping cycle of the product 2 with a new strip 8.

The above is the description of a conveying device with levers, provided with a gripping device for gripping strips of wrapping material for delicate products, in which one of the levers of the conveying device cooperates with a fixed limit stop on the same device to form the gripping device.

We must point out again that although one embodiment has been described above, modifications could be made to it, without radically altering the invention. For example, to increase the device's dragging capacity, an adhesive element could be placed on the end part 29 to cooperate with element 30 to grip the end 11 of strip 8.

In addition, the command lever 19 could control the operating lever 24 and operating lever 16 could be kinematically connected to the operating lever 24 by means of a gear like that shown in FIGS. 1 and 5.

I claim:

1. In a conveying device with levers for wrapping delicate products, equipped with a gripping device for strips of material for wrapping products, said conveying device, having:

a supporting structure sliding on a radial guide which forms part of a carrousel conveyor revolving around a support placed on a supporting plate;

a first operating lever and a second operating lever mounted for rotation around first and second pivots for movement toward and away from each other, said first and second pivots being supported by said supporting structure;

the improvement comprising a limit stop positioned to act in conjunction with said first operating lever to constitute a gripping device for said strips; said limit stop being positioned to limit the movement of said first operating lever in a direction away from said second operating lever, said limit stop being mounted integral with said supporting structure and independent of said first and second operating levers;

said improvement further comprising means to control movements of said levers;

said machine furthermore having a guiding device for ends of said strips.

2. A conveying device as in claim 1, wherein said limit stop comprises a bracket which projects laterally from said supporting structure.

3. A conveying device as in claim 2, wherein said bracket has a free end and a curvature which allows said free end to be in a position to give access to a free end of said first operating lever.

4. Conveying device as in claim 3, wherein said bracket is made of elastic material which bends when contacted by said free end of said first lever.

5. Conveying device as in claim 2, wherein the bracket is placed in a front part of said supporting structure in the direction of rotation of said conveying device.

6. A conveying device according to claim 3, wherein said free end of said first lever carries an elastic element to grip an end of said strip.

7. A conveying device as in claim 1, wherein movements of said first operating lever are controlled by a command lever, having a first end integral with said first lever and a second end supporting a bearing which is slidingly mounted in a grooved section in said supporting plate, the first operating lever having a first gear, the second operating lever having a second gear meshed with said first gear, so that movements of the second operating lever are controlled by said first gear.

8. A conveying device as in claim 1, wherein said guiding devices for said ends of said strips comprises an internal surface of a guiding component, said internal surface being positioned to bring the strip almost into contact with a flat supporting surface carried by said conveying device.

9. A conveying device as in claim 8, wherein said guiding component is positioned next to a feeding device for said strips and in a position in relation to said machine so that said strip is situated between said flat support surface and a side of said product.

10. A conveying device as in claim 2, including a second adhesive element placed on said end part of said bracket to cooperate with said first element to grip said end of said strip.

* * * * *